US005879538A

United States Patent [19]

Haritatos

[11] Patent Number: 5,879,538

[45] Date of Patent: Mar. 9, 1999

[54] ZEOLITE L CATALYST IN CONVENTIONAL FURNACE

[75] Inventor: Nicholas J. Haritatos, El Cerrito, Calif.

[73] Assignee: Chevron Chemical Company, San Ramon, Calif.

[21] Appl. No.: 995,587

[22] Filed: Dec. 22, 1997

[51] Int. Cl.[6] ..... C10G 35/06

[52] U.S. Cl. ..... 208/137; 208/138

[58] Field of Search ..... 208/134, 137, 208/138

[56] References Cited

U.S. PATENT DOCUMENTS 4,507,397 3/1985 Buss ..... 502/38

4,595,670 6/1986 Tauster et al. ..... 502/74

*Primary Examiner*—Walter D. Griffin
*Assistant Examiner*—Tam Nguyen
*Attorney, Agent, or Firm*—Thomas G. DeJonghe

[57] ABSTRACT

A process for catalytic reforming of feed hydrocarbons to form aromatics, comprising contacting the feed, under catalytic reforming conditions, with catalyst particles disposed in the tubes of a furnace, wherein the catalyst is a monofunctional, non-acidic catalyst and comprises a Group VIII metal and zeolite L, and wherein the furnace tubes are from 2 to 8 inches in inside diameter, and wherein the furnace tubes are heated, at least in part, by gas or oil burners located outside the furnace tubes.

16 Claims, No Drawings

ZEOLITE L CATALYST IN CONVENTIONAL FURNACE

BACKGROUND OF THE INVENTION

The present invention relates to catalytic reforming using a catalyst comprising zeolite L. More particularly, the present invention pertains to use of such catalyst in a conventional gas or oil fired furnace.

Reforming embraces several reactions, such as dehydrogenation, isomerization, dehydroisomerization, cyclization and dehydrocyclization. In the process of the present invention, aromatics are formed from the feed hydrocarbons to the reforming reaction zone, and dehydrocyclization is the most important reaction.

U.S. Pat. No. 4,104,320 to Bernard and Nury discloses that it is possible to dehydrocyclize paraffins to produce aromatics with high selectivity using a monofunctional non-acidic type-L zeolite catalyst. The L zeolite based catalyst in '320 has exchangeable cations of which at least 90% are sodium, lithium, potassium, rubidium or cesium, and contains at least one Group VIII noble metal (or tin or germanium). In particular, catalysts having platinum on potassium form L-zeolite exchanged with a rubidium or cesium salt were claimed by Bernard and Nury to achieve exceptionally high selectivity for n-hexane conversion to benzene. As disclosed in the Bernard and Nury patent, the L zeolites are typically synthesized in the potassium form. A portion, usually not more than 80%, of the potassium cations can be exchanged so that other cations replace the exchangeable potassium.

Later, a further important step forward was disclosed in U.S. Pat. Nos. 4,434,311; 4,435,283; 4,447,316; and 4,517,306 to Buss and Hughes. The Buss and Hughes patents describe catalysts comprising a large pore zeolite exchanged with an alkaline earth metal (barium, strontium or calcium, preferably barium) containing one or more Group VIII metals (preferably platinum) and their use in reforming petroleum naphthas. An essential element in the catalyst is the alkaline earth metal. Especially when the alkaline earth metal is barium, and the large-pore zeolite is L-zeolite, the catalysts were found to provide even higher selectivities than the corresponding alkali exchanged L-zeolite catalysts disclosed in U.S. Pat. No. 4,104,320.

These high selectivity catalysts of Bernard and Nury, and of Buss and Hughes, are all "non-acidic" and are referred to as "monofunctional catalysts". These catalysts are highly selective for forming aromatics via dehydrocyclization of paraffins.

Having discovered a highly selective catalyst, commercialization seemed promising. Unfortunately, that was not the case, because the high selectivity, L-zeolite catalysts did not achieve long enough run length to make them feasible for use in catalytic reforming. U.S. Pat. No. 4,456,527 discloses the surprising finding that if the sulfur content of the feed was reduced to ultra low levels, below levels used in the past for catalysts especially sensitive to sulfur, that then long run lengths could be achieved with the L-zeolite non-acidic catalyst. Specifically, it was found that the concentration of sulfur in the hydrocarbon feed to the L-zeolite catalyst should be at ultra low levels, preferably less than 100 parts per billion (ppb), more preferably less than 50 ppb, to achieve improved stability/activity for the catalyst used.

It was also found that L zeolite reforming catalysts are surprisingly sensitive to the presence of water, particularly while under reaction conditions. Water has been found to greatly accelerate the rate of deactivation of these catalysts.

U.S. Pat. No. 4,830,732 discloses the surprising sensitivity of L zeolites to water and ways to mitigate the problem.

U.S. Pat. No. 5,382,353 and U.S. Pat. No. 5,620,937 to Mulaskey et al. disclose a zeolite L based reforming catalyst wherein the catalyst is treated at high temperature and low water content to thereby improve the stability of the catalyst, that is, to lower the deactivation rate of the catalyst under reforming conditions.

Also, several patents and patent applications of RAULO (Research Association for Utilization of Light Oil) and Idemitsu Kosan Co. have been published relating to use of halogen in L-zeolite based monofunctional reforming catalysts. Such halogen containing monofunctional catalysts have been reported to have improved stability (catalyst life) when used in catalytic reforming, particularly in reforming feedstocks boiling above $C_7$ hydrocarbons in addition to C6 and C7 hydrocarbons. In this regard, see EP 201,856A; EP 498,182A; U.S. Pat. No. 4,681,865; and U.S. Pat. No. 5,091,351.

EP 403,976 to Yoneda et al., and assigned to RAULO, discloses the use of fluorine treated zeolite L based catalysts in small diameter tubes of about one-inch inside diameter (22.2 mm to 28 mm in the examples). Heating medium proposed for the small tubes were molten metal or molten salt so as to maintain precise control of the temperature of the tubes. Accordingly, EP 403,976 does not teach the use of a conventional type furnace or conventional type furnace tubes. Conventional furnaces for catalytic reforming have tubes of usually three or more inches in inside diameter (76 mm or more), whereas EP 403,976 teaches that using tubes having an inside diameter greater than 50 mm is undesirable. Also, conventional furnaces are heated using gas or oil fired burners.

Typical catalytic reforming processes employ a series of conventional furnaces to heat the naphtha feedstock before each reforming reactor stage, as the reforming reaction is endothermic. Thus, in a three-stage reforming process, the overall reforming unit would comprise a first furnace followed by a first-stage reactor vessel containing the reforming catalyst (over which catalyst the endothermic reforming reaction occurs); a second furnace followed by a second-stage reactor containing reforming catalyst over which the reforming reaction is further progressed; and a third furnace followed by a third-stage reactor with catalyst to further progress the reforming reaction conversion levels.

For example, U.S. Pat. No. 4,155,835 to Antal illustrates a three-stage reforming process, with three furnaces (30, 44, 52) and three reforming reactors (40, 48, 56) shown in the drawing in Antal. Example reforming reactors used according to the prior art are shown, for instance, in U.S. Pat. No. 5,211,837 to Russ et al., particularly the radial flow reactor shown in FIG. 2 of Russ et al.

In some catalytic reforming units, as many as five or six stages of furnaces followed by reactors are used in series for the catalytic reforming unit.

SUMMARY OF THE INVENTION

According to the present invention, a process for catalytic reforming of feed hydrocarbons is provided. The process comprises contacting the feed, under catalytic reforming conditions, with catalyst particles disposed in the tubes of a furnace, wherein the catalyst is a monofunctional, non-acidic catalyst and comprises a Group VIII metal and zeolite L, and wherein the furnace tubes are from 2 to 8 inches in inside diameter, and wherein the furnace tubes are heated, at least in part, by gas or oil burners located outside the furnace tubes.

In the present invention, the furnace is basically a conventional type furnace, except that catalyst is disposed in the tubes of the furnace. The furnace is heated by conventional means for naphtha reforming units, such as by gas burners or oil burners. Also, in the present invention, the size of the tubes is conventional, in the range 2 to 8 inches, preferably 3 to 6 inches, more preferably 3 to 4 inches, in inside diameter. Monofunctional L-zeolite based catalyst is contained inside the tubes of the conventional furnace in accordance with the present invention.

Among other factors, the present invention is based on my conception and unexpected finding that, using the catalysts defined herein, particularly non-acidic, monofunctional zeolite L based reforming catalyst, the conventional arrangement of furnaces and multi-stage reforming reactors can be coalesced into one or more stages of conventional furnaces, eliminating the reformer reactor vessels downstream of the furnace. In the present invention, the defined monofunctional reforming catalyst is disposed in the tubes of a conventional furnace. A preferred embodiment of the present invention is also based on my finding that a conventional multi-stage furnaces/reactors reforming arrangement (consisting of, for example, three to six stages of furnaces and reactors) can be replaced by one basically conventional furnace containing monofunctional zeolite L reforming catalyst in the tubes of the furnace.

As stated in the Background, U.S. Pat. No. 4,155,835 illustrates the use of a three-stage reforming unit comprising three conventional furnaces, and three reforming reactor vessels containing catalyst, with one reactor being located downstream of each of the three furnaces. In contrast, the present invention coalesces or collapses the furnaces and separate reactors into one or more furnace tubes reactor system, without the separate reactor vessels. According to the present invention, preferably, the system is only one furnace tube reactor, that is, coalescence to one furnace, containing tubes with catalyst disposed in the tubes.

I have found that the present invention is particularly advantageously carried out at relatively low hydrogen to hydrocarbon feed ratios of 0.5 to 3.0, preferably 0.5 to 2.0, more preferably 1.0 to 2.0, most preferably 1.0 to 1.5, on a molar basis.

I have also found that in the process of the present invention high space velocities can be used. Preferred space velocities are from 1.0 to 7.0 volumes of feed per hour per volume of catalyst, more preferably 1.5 to 6 $hour^{-1}$, and still more preferably 3 to 5 $hour^{-1}$.

Preferably, the Group VIII metals used in the catalyst disposed in the furnace tubes are platinum, palladium, iridium, and other Group VIII metals. Platinum is most preferred as the Group VIII metal in the catalyst used in the present invention.

Also, preferred catalysts for use in the present invention are non-acidic zeolite L catalysts, wherein exchangeable ions from the zeolite L, such as sodium and/or potassium, have been exchanged with alkali or alkaline earth metals. A particularly preferred catalyst is PtBaL zeolite, wherein the zeolite L has been exchanged using a barium containing solution. These catalysts are described in more detail in the Buss and Hughes references cited above in the Background section, which references are incorporated herein by reference, particularly as to description of Pt L zeolite catalyst.

According to another preferred embodiment of the present invention, the zeolite L based catalyst is produced by treatment in a gaseous environment in a temperature range between 1025° F. and 1275° F. while maintaining the water level in the effluent gas below 1000 ppm. Preferably, the high temperature treatment is carried out at a water level in the effluent gas below 200 ppm. Preferred high temperature treated catalysts are described in the Mulaskey et al. patents cited above in the Background section, which references are incorporated by reference herein, particularly as to description of high temperature treated Pt L zeolite catalysts.

According to another preferred embodiment of the present invention, the zeolite L based catalyst contains at least one halogen in an amount between 0.1 and 2.0 wt. % based on zeolite L. Preferably, the halogens are fluorine and chlorine and are present on the catalyst in an amount between 0.1 and 1.0 wt. % fluorine and 0.1 and 1.0 wt. % chlorine at the Start of Run. Preferred halogen containing catalysts are described in the RAULO and IKC patents cited above in the Background section, which references are incorporated by reference herein, particularly as to description of halogen containing Pt L zeolite catalysts.

Preferred feeds for the process of the present invention are naphtha boiling range hydrocarbons, that is, hydrocarbons boiling within the range of $C_6$ to $C_{10}$ paraffins and napthenes, more preferably in the range of $C_6$ to $C_8$ paraffins and napthenes, and most preferably of $C_6$ to $C_7$ paraffins and napthenes. The feedstock can contain minor amounts of hydrocarbons boiling outside the specified range, such as 5 to 20%, preferably only 2 to 7% by weight. There are several different paraffins at each of the various carbon numbers. Accordingly, it will be understood that the boiling point has some range or variation at a given carbon number cut point. Typically, the paraffin rich feed is derived by fractionation of a petroleum crude oil.

In the present invention, preferably the feed contains less than 50 ppb sulfur, more preferably less than 10 ppb sulfur. In the present invention, the furnace tubes are filled with catalyst, and the conventional furnace and tubes are used as a combination heating means and catalytic reaction means. In the present invention, low catalyst deactivation rates are important. Ultra low sulfur in the feed contributes to the success of the present invention. Preferably, the catalyst selected for use and reaction conditions selected are such that the catalyst deactivation rate is controlled to less than 0.04° F. per hour, more preferably less than 0.03° F., and most preferably less than 0.01° F. per hour.

The present invention may again be contrasted to U.S. Pat. No. 4,155,835 to Antal. The Antal reference uses reformer reactor vessels separate from the conventional furnaces, whereas the present invention does not.

Further, although the Antal process reduces the sulfur to very low sulfur levels in the feed, as low as 0.2 ppm sulfur, the present invention is preferably carried out at sulfur levels more than an order of magnitude lower, such as below 10 ppb sulfur, in the feed to the monofunctional zeolite L based catalyst contained in the tubes of the furnace tube reactor system of the present invention.

Preferred reforming conditions for the conventional furnace tubes filled with the monofunctional zeolite L based catalyst include a LHSV between 1.5 and 6; a hydrogen to hydrocarbon ratio between 0.5 and 3.0; and a furnace tube temperature for the reactants (interior temperature) between 600° F. and 960° F. at the inlet and between 860° F. and 960° F. at the outlet at Start of Run (SOR), and between 600° F. and 1025° F. at the inlet and between 920° F. and 1025° F. at the outlet at End of Run (EOR).

DETAILED DESCRIPTION OF THE INVENTION

The catalyst used in the process of the present invention comprises a Group VIII metal and zeolite L. The catalyst of the present invention is a non-acidic, monofunctional catalyst.

The Group VIII metal of the catalyst of the present invention preferably is a noble metal, such as platinum or palladium. Platinum is particularly preferred. Preferred amounts of platinum are 0.1 to 5 wt. %, more preferably 0.1 to 3 wt. %, and most preferably 0.3 to 1.5 wt. %, based on zeolite L.

The zeolite L component of the catalyst is described in published literature, such as U.S. Pat. No. 3,216,789. The chemical formula for zeolite L may be represented as follows:

$$(9.9\text{-}1.3)M_{2/n}O:Al_2O_3(5.2\text{-}6.9)SiO_2:yH_2O$$

wherein M designates a cation, n represents the valence of M, and y may be any value from 0 to about 9. Zeolite L, its X-ray diffraction pattern, its properties, and method for its preparation are described in detail in U.S. Pat. No. 3,216,789. Zeolite L has been characterized in "Zeolite Molecular Sieves" by Donald W. Breck, John Wiley and Sons, 1974, (reprinted 1984) as having a framework comprising 18 tetrahedra unit cancrinite-type cages linked by double six rings in columns and cross-linked by single oxygen bridges to form planar 12-membered rings. The hydrocarbon sorption pores for zeolite L are reportedly approximately 7 Å in diameter. The Breck reference and U.S. Pat. No. 3,216,789 are incorporated herein by reference, particularly with respect to their disclosure of zeolite L.

The various zeolites are generally defined in terms of their X-ray diffraction patterns. Several factors have an effect on the X-ray diffraction pattern of a zeolite. Such factors include temperature, pressure, crystal size, impurities and type of cations present. For instance, as the crystal size of the type-L zeolite becomes smaller, the X-ray diffraction pattern becomes somewhat broader and less precise. Thus, the term "zeolite L" includes any of the various zeolites made of cancrinite cages having an X-ray diffraction pattern substantially the same as the X-ray diffraction patterns shown in U.S. Pat. No. 3,216,789. Type-L zeolites are conventionally synthesized in the potassium form, that is, in the theoretical formula previously given, most of the M cations are potassium. M cations are exchangeable so that a given type-L zeolite, for example, a type-L zeolite in the potassium form, can be used to obtain type-L zeolites containing other cations by subjecting the type-L zeolite to ion-exchange treatment in an aqueous solution of an appropriate salt or salts. However, it is difficult to exchange all the original cations, for example, potassium, since some cations in the zeolite are in sites which are difficult for the reagents to reach. Preferred L zeolites for use in the present invention are those synthesized in the potassium form. Preferably, the potassium form L zeolite is ion exchanged to replace a portion of the potassium, most preferably with an alkaline earth metal, barium being an especially preferred alkaline earth metal for this purpose as previously stated.

The catalysts used in the process of the present invention are monofunctional catalysts, meaning that they do not have the acidic function of conventional reforming catalysts. Traditional or conventional reforming catalysts are bifunctional, in that they have an acidic function and a metallic function. Examples of bifunctional catalysts include platinum on acidic alumina as disclosed in U.S. Pat. No. 3,006,841 to Haensel; platinum-rhenium on acidic alumina as disclosed in U.S. Pat. No. 3,415,737 to Kluksdahl; platinum-tin on acidic alumina; and platinum-iridium with bismuth on an acidic carrier as disclosed in U.S. Pat. No. 3,878,089 to Wilhelm (see also the other acidic catalysts containing bismuth, cited above in the Background section).

Examples of monofunctional catalysts include platinum on zeolite L, wherein the zeolite L has been exchanged with an alkali metal, as disclosed in U.S. Pat. No. 4,104,320 to Bernard et al.; platinum on zeolite L, wherein the zeolite L has been exchanged with an alkaline earth metal, as disclosed in U.S. Pat. No. 4,634,518 to Buss and Hughes; platinum on zeolite L as disclosed in U.S. Pat. No. 4,456,527 to Buss, Field and Robinson; and platinum on halogenated zeolite L as disclosed in the RAULO and IKC patents cited above.

According to another embodiment of the present invention, the catalyst is a high temperature reduced or activated (HTR) catalyst.

Preferably, the pretreatment process used on the catalyst occurs in the presence of a reducing gas such as hydrogen, as described in U.S. Pat. No. 5,382,353 issued Jan. 17, 1995,and U.S. patent application Ser. No. 08/475,821 which are hereby expressly incorporated by reference in their entirety. Generally, the contacting occurs at a pressure of from 0 to 300 psig and a temperature of from 1025° F. to 1275° F. for from 1 hour to 120 hours, more preferably for at least 2 hours, and most preferably for at least 4–48 hours. More preferably, the temperature is from 1050° F. to 1250° F. In general, the length of time for the pretreatment will be somewhat dependent upon the final treatment temperature, with the higher the final temperature the shorter the treatment time that is needed.

For a commercial size plant, it is necessary to limit the moisture content of the environment during the high temperature treatment in order to prevent significant catalyst deactivation. In the temperature range of from 1025° F. to 1275° F., the presence of moisture is believed to have a severely detrimental effect on the catalyst activity. It has therefore been found necessary to limit the moisture content of the environment to as little water as possible during said treatment period, to at least less than 200 ppmv, preferably less than 100 ppmv water.

In one embodiment, in order to limit exposure of the catalyst to water vapor at high temperatures, it is preferred that the catalyst be reduced initially at a temperature between 300° F. and 700° F. After most of the water generated during catalyst reduction has evolved from the catalyst, the temperature is raised slowly in ramping or stepwise fashion to a maximum temperature between 1025° F. and 1250° F.

The temperature program and gas flow rates should be selected to limit water vapor levels in the reactor effluent to less than 200 ppmv and, preferably, less than 100 ppmv when the catalyst bed temperature exceeds 1025° F. The rate of temperature increase to the final activation temperature will typically average between 5° and 50° F. per hour. Generally, the catalyst will be heated at a rate between 10° and 25° F. per hour. It is preferred that the gas flow through the catalyst bed during this process exceed 500 volumes per volume of catalyst per hour, where the gas flow volume is measured at standard conditions of one atmosphere and 60° F. In other words, the gas flow volume is greater than 500 gas hourly space volume (GHSV). GHSVs in excess of 5000 per hour will normally exceed the compressor capacity. GHSVs between 600 and 2000 per hour are most preferred.

The pretreatment process occurs prior to contacting the reforming catalyst with a hydrocarbon feed. The large-pore zeolitic catalyst is generally treated in a reducing atmosphere in the temperature range of from 1025° F. to 1275° F. Although other reducing gasses can be used, dry hydrogen is preferred as a reducing gas. The hydrogen is generally mixed with an inert gas such as nitrogen, with the amount of hydrogen in the mixture generally ranging from 1% to 99% by volume. More typically, however, the amount of hydrogen in the mixture ranges from about 10 to 50% by volume.

In another embodiment, the catalyst can be pretreated using an inert gaseous environment in the temperature range of from 1025°–1275° F., as described in U.S. patent application Ser. No. 08/450,697, filed May 25, 1995, which is hereby expressly incorporated by reference in its entirety.

The preferred inert gas is nitrogen, for reasons of availability and cost. Other inert gases, however, can be used such as helium, argon, and krypton or mixtures thereof.

According to an especially preferred embodiment of the present invention, the non-acidic, monofunctional catalyst used in the process of the present invention contains a halogen. This may be confusing at first, in that halogens are often used to contribute to the acidity of alumina supports for acidic, bifunctional reforming catalysts. However, the use of halogens with catalysts based on zeolite L can be made while retaining the non-acidic, monofunctional characteristic of the catalyst. Methods for making non-acidic halogen containing zeolite L based catalysts are disclosed in the RAULO and IKC references cited above in the Background section.

The term "non-acidic" is understood by those skilled in this area of art, particularly by the contrast between monofunctional (non-acidic) reforming catalysts and bifunctional (acidic) reforming catalysts. One method of achieving non-acidity is by the presence of alkali and/or alkaline earth metals in the zeolite L, and preferably is achieved, along with other enhancement of the catalyst, by exchanging cations such as sodium and/or potassium from the synthesized L zeolite using alkali or alkaline earth metals. Preferred alkali or alkaline earth metals for such exchanging include potassium and barium.

The term "non-acidic" also connotes high selectivity of the catalyst for conversion of aliphatics, especially paraffins, to aromatics, especially benzene, toluene and/or xylenes. High selectivity includes at least 30% selectivity for aromatics formation, preferably 40%, more preferably 50%. Selectivity is that percent of the conversion which goes to aromatics, especially to BTX (Benzene, Toluene, Xylene) aromatics when feeding a $C_6$ to $C_8$ aliphatic feed.

Preferred feeds to the process of the present invention are $C_6$ to $C_9$ naphthas. The catalyst of the present invention has an advantage with paraffinic feeds which normally give poor aromatics yields with conventional bifunctional reforming catalysts. However, naphthenic feeds are also readily converted to aromatics over the catalyst of the present invention.

More preferably, feeds to the process of the present invention are $C_6$ to $C_7$ naphthas. The furnace tube reactor system of the present invention is particularly advantageously applied to converting $C_6$ and $C_7$ naphthas to aromatics.

Particularly preferred catalytic reforming conditions for the present invention include, as described above under Summary of the Invention, an LHSV between 1.5 and $6.0^{-1}$, a hydrogen to hydrocarbon ratio between 0.5 and 2.0, a reactants temperature between 600° F. and 1025° F., and an outlet pressure between 35 and 75 psig.

Preferably, the catalyst used in the process of the present invention is bound. Binding the catalyst improves its crush strength, compared to a non-bound catalyst comprising platinum on zeolite L powder. Preferred binders for the catalyst of the present invention are alumina or silica. Silica is especially preferred for the catalyst used in the present invention. Preferred amounts of binder are from 5 to 90 wt. % of the finished catalyst, more preferably from 10 to 50 wt. %, and still more preferably from 10 to 30 wt. %.

As the catalyst may be bound or unbound, the weight percentages given herein are based on the zeolite L component of the catalyst, unless otherwise indicated.

The term "catalyst" is used herein in a broad sense to include the final catalyst as well as precursors of the final catalyst. Precursors of the final catalyst include, for example, the unbound form of the catalyst and also the catalyst prior to final activation by reduction. The term "catalyst" is thus used to refer to the activated catalyst in some contexts herein, and in other contexts to refer to precursor forms of the catalyst, as will be understood by skilled persons from the context.

Also with regard to use of the halogenated form of the monofunctional catalyst in the present invention, the percent halogen in the catalyst is that at Start of Run (SOR). During the course of the run or use of the catalyst, some of the halogen usually is lost from the catalyst.

The furnace tube reactor system of the present invention refers to a system in which non-acidic, highly selective zeolite L based catalyst is contained within a plurality of conventional furnace tubes which are themselves contained within a furnace. The furnace tubes are preferably parallel to each other and are preferably vertically arranged. Typically, rows of furnace tubes alternate with rows of burners. The tubes are preferably 2 to 8 inches in diameter, more preferably 3 to 6 inches in diameter, and most preferably 3 to 4 inches in diameter, and can be up to 45 feet long. The furnace tubes are preferably less than or equal to 30 feet long and preferably are at least 10 feet long. Feed typically comes in at the top of the tubes. The burners are typically mounted in the roof of the furnace and fire down into the firebox. The maximum heat flux would then be at the point where feed is coming into the furnace tubes. Alternatively, a multi-zone furnace can be used.

Furnace tube reactors can be linked in series or parallel, but preferably the system is designed so that a single furnace tube reactor is used. We have found that this results in greatly reduced investment costs.

As stated earlier, I have also found that in the process of the present invention high space velocities are advantageously used. Relatively high space velocities allow lower total tube volume to be used. Lower space rates conversely require more tube volume to contain the appropriate (desired) amount of catalyst and thus may be less desirable, particularly if the total furnace size must be significantly larger to accommodate the increased volume of tubes.

The diameter and length of the furnace tubes can be varied so that a desired pressure drop and heat flux across the tubes is attained. The length and diameter of the furnace tubes, and the location and number of burners, allow for regulation of the skin temperature of the furnace tubes as well as the radial and axial temperature profile of the furnace tubes. These parameters can be designed to allow for appropriate conversion of particular feeds. However, the concept of the present invention requires that the furnace be basically conventional. Accordingly, the size of the furnace tubes will be at least two inches in inside diameter, more preferably at least three inches in inside diameter. Also, the furnace will be heated by conventional means, such as by gas or oil fired burners.

The pressure drop across the length of the furnace tubes preferably is less than or equal to 70 psi, more preferably less than 60 psi, most preferably less than 50 psi. The outlet pressure is preferably 25 to 100 psig, more preferably 35 to 75 psig, and most preferably 40 to 50 psig. The outlet pressure is the reaction mixture pressure at the outlet of the furnace tubes, that is, as the tubes and contained reaction mixture come out of the furnace.

EXAMPLES

Example 1

This example compares a conventional adiabatic multistage reactor system to the externally heated furnace tube reactor of the present invention. The catalyst used in this comparison is platinum on halogenated zeolite L as disclosed in the RAULO and IKC patents cited earlier. The total volume of catalyst in the two systems is the same. The same light naphtha is used as feed to both reactor systems. The light naphtha feed contained 2 percent $C_5$'s, 90 percent $C_6$'s (primarily paraffins but also minor amounts of napthenes), and 8 percent by volume $C_7$'s. The conditions and parameters in the example have been adjusted to give the same total run length for the two systems in the comparison.

| | Externally heated furnace tube | Adiabatic multi-stage reactor system | | | | | |
|---|---|---|---|---|---|---|---|
| | reactor | 1st | 2nd | 3rd | 4th | 5th | 6th |
| Tube inner diameter, inches | 3 | | | | | | |
| Number of tubes | 800 | | | | | | |
| Tube length, feet | 15 | | | | | | |
| Catalyst volume, cubic feet | 580 | 60 | 60 | 60 | 115 | 115 | 170 |
| Temperature at reactor inlet, °F. | 900 | 945 | 950 | 955 | 960 | 965 | 970 |
| Inlet pressure, psig | 85 | | | 85 | | | |
| Outlet pressure | 45 | | | 45 | | | |
| Liquid Hourly Space Velocity, (1/hr.) | 4 | | | 4 | | | |
| Feed | Light naphtha | | | Light naphtha | | | |
| $H_2$/Hydrocarbon mole ratio | 1 | | | 1 | | | |
| $C_5$ + yield, wt. % of feed | 83.4 | | | 89.6 | | | |
| Wt. % aromatics in $C_5$+ | 88.8 | | | 66.7 | | | |

This example shows that, in accordance with the concept of the present invention, a six-reactor multi-stage reactor system can be effectively replaced by a single externally heated conventional furnace with catalyst disposed in the tubes of the furnace. The present invention also provides an increased aromatics yield. We have also found the this result can be accomplished in the furnace tube reactor system of the present invention at a lower peak catalyst temperature versus the use of multi-stage adiabatic reactors with conventional furnaces preceding each of the reactor stages.

Example 2

This example compares a conventional adiabatic multi-stage reactor system to the furnace tube reactor system of the present invention. The catalyst used in this comparison is platinum on halogenated zeolite L, as disclosed in the RAULO and IKC patents cited earlier. The diameter of tubes in this example in the furnace tube reactor is larger than in the first example and the total volume of catalyst is twice as much as in the first example. The total volume of catalyst in the two compared systems is the same (1170 cubic feet). The same light naphtha is used as feed to both reactor systems. The conditions and parameters in the example have been adjusted to give the same total run length for the two systems in the comparison.

| | Externally heated furnace tube | Adiabatic multi-stage reactor system | | | | | |
|---|---|---|---|---|---|---|---|
| | reactor | 1st | 2nd | 3rd | 4th | 5th | 6th |
| Tube inner diameter, inches | 4 | | | | | | |
| Number of tubes | 610 | | | | | | |
| Tube length, feet | 22 | | | | | | |
| Catalyst volume, cubic feet | 1170 | 120 | 120 | 120 | 230 | 230 | 350 |
| Temperature at reactor inlet, °F. | 920 | 970 | 970 | 975 | 980 | 980 | 985 |
| Inlet pressure, psig | 85 | | | 85 | | | |
| Outlet pressure | 45 | | | 45 | | | |
| Liquid Hourly Space Velocity, (1/hr.) | 2.0 | | | 2.0 | | | |
| Feed | Light naphtha | | | Light naphtha | | | |
| $H_2$/Hydrocarbon mole ratio | 1.0 | | | 1.0 | | | |
| $C_5$ + yield, wt. % of feed | 78.9 | | | 86.4 | | | |
| Wt. % aromatics in $C_5$+ | 93.9 | | | 80.0 | | | |

Example 3

In the following example, a high temperature reduced catalyst is used in an externally heated furnace tube reactor and compared to use of the same HTR catalyst in an adiabatic multi-stage reactor system.

| | Externally heated furnace tube | Adiabatic multi-stage reactor system | | | | | |
|---|---|---|---|---|---|---|---|
| | reactor | 1st | 2nd | 3rd | 4th | 5th | 6th |
| Tube inner diameter, inches | 4 | | | | | | |
| Number of tubes | 740 | | | | | | |
| Tube length, feet | 24 | | | | | | |
| Catalyst volume, cubic feet | 1550 | 150 | 150 | 150 | 320 | 320 | 460 |
| Temperature at reactor inlet, °F. | 900 | 935 | 940 | 940 | 945 | 950 | 960 |
| Inlet pressure, psig | 85 | | | 85 | | | |
| Outlet pressure | 45 | | | 45 | | | |
| Liquid Hourly Space Velocity, (1/hr.) | 1.5 | | | 1.5 | | | |
| Feed | Light naphtha | | | Light naphtha | | | |
| $H_2$/Hydrocarbon mole ratio | 3 | | | 3 | | | |
| $C_5$ + yield, wt. % of feed | 80.1 | | | 86.5 | | | |
| Wt. % aromatics in $C_5$+ | 91.2 | | | 75.2 | | | |

This example illustrates that a six-reactor multi-stage reactor system can be effectively replaced by a system in accord with the present invention wherein catalyst is disposed in the tubes of a conventional single externally heated furnace. The catalyst used in this example is a high temperature reduced catalyst comprising Pt on L zeolite. This example also illustrates that the system of the present invention provides an increased aromatics yield. This result is accomplished at a lower peak catalyst temperature in the externally heated furnace tube reactor system than in the system comprising several furnaces and separate reactors in series.

What is claimed is:

1. A process for catalytic reforming of feed hydrocarbons to form aromatics, comprising contacting the feed, under catalytic reforming conditions, with catalyst particles disposed in the tubes of a furnace, wherein the catalyst is a monofunctional, non-acidic catalyst and comprises a Group VIII metal and zeolite L, and wherein the furnace tubes are from 2 to 8 inches in inside diameter, and wherein the furnace tubes are heated, at least in part, by gas or oil burners located outside the furnace tubes.

2. A process in accordance with claim 1 wherein the furnace tubes are 3 to 6 inches in diameter.

3. A process in accordance with claim 1 wherein the catalytic reforming conditions include a LHSV of 1.0 to 7.

4. A process in accordance with claim 1 wherein the catalytic reforming conditions include a LHSV of 3 to 5.

5. A process in accordance with claim 1 wherein the catalytic reforming conditions include a hydrogen to hydrocarbon molar ratio of 0.5 to 3.0.

6. A process in accordance with claim 3 wherein the catalytic reforming conditions include a hydrogen to hydrocarbon molar ratio of 1.0 to 1.5.

7. A process in accordance with claim 1 wherein the Group VIII metal is platinum.

8. A process in accordance with claim 1 wherein the catalyst is produced by steps comprising treatment in a gaseous environment in a temperature range between 1025° F. and 1275° F. while maintaining the water level in the effluent gas below 1000 ppm.

9. A process in accordance with claim 8 wherein the water level is below 200 ppm.

10. A process in accordance with claim 1 wherein the catalyst contains at least one halogen in an amount between 0.1 and 2.0 wt. % based on zeolite L.

11. A process in accordance with claim 10 wherein the halogens are fluorine and chlorine and are present on the catalyst in an amount between 0.1 and 1.0 wt. % fluorine and 0.1 and 1.0 wt. % chlorine at the Start of Run.

12. A process in accordance with claim 1 wherein at least 80% of the hydrocarbon feed boils within the range of $C_6$ to $C_{10}$ paraffins.

13. A process in accordance with claim 10 wherein at least 80% of the feed boils between $C_6$ and $C_8$.

14. A process in accordance with claim 1 wherein the feed contains less than 50 ppb sulfur.

15. A process in accordance with claim 12 wherein the feed contains less than 10 ppb sulfur.

16. A process in accordance with claim 1 wherein the catalytic reforming conditions include a LHSV between 3 and 5, a hydrogen to hydrocarbon molar ratio between 1 and 1.5, a furnace tube interior temperature between 600° F. and 960° F. at the inlet and between 860° F. and 1025° F. at the outlet at SOR and between 600° F. and 1025° F. at the inlet and between 920° F. and 1025° F. at the outlet at EOR, and an outlet pressure of between 35 and 75 psig.

* * * * *